US011462823B2

(12) United States Patent
Oh et al.

(10) Patent No.: US 11,462,823 B2
(45) Date of Patent: Oct. 4, 2022

(54) ANTENNA STRUCTURE

(71) Applicant: DONGWOO FINE-CHEM CO., LTD., Jeollabuk-do (KR)

(72) Inventors: Yun Seok Oh, Gyeonggi-do (KR); Young Jun Lee, Seoul (KR); Yoon Ho Huh, Seoul (KR)

(73) Assignee: DONGWOO FINE-CHEM CO., LTD., Jeollabuk-Do (KR)

( * ) Notice: Subject to any disclaimer, the term of this patent is extended or adjusted under 35 U.S.C. 154(b) by 0 days.

(21) Appl. No.: 16/982,156

(22) PCT Filed: Mar. 24, 2020

(86) PCT No.: PCT/KR2020/003999
§ 371 (c)(1),
(2) Date: Sep. 18, 2020

(87) PCT Pub. No.: WO2020/204436
PCT Pub. Date: Oct. 8, 2020

(65) Prior Publication Data

US 2022/0006180 A1 Jan. 6, 2022

(30) Foreign Application Priority Data

Mar. 29, 2019 (KR) ..... 10-2019-0036794

(51) Int. Cl.
*H01Q 1/38* (2006.01)
*H01Q 1/48* (2006.01)

(52) U.S. Cl.
CPC ..... *H01Q 1/38* (2013.01); *H01Q 1/48* (2013.01)

(58) Field of Classification Search
CPC ..... H01Q 1/22–48; H01Q 21/065
See application file for complete search history.

(56) References Cited

U.S. PATENT DOCUMENTS

| | | | | |
|---|---|---|---|---|
| 8,378,914 | B2 * | 2/2013 | Lee | H01Q 9/285 343/822 |
| 2008/0094282 | A1 | 4/2008 | Qin | |
| 2017/0125890 | A1 | 5/2017 | Jeong | |
| 2018/0048075 | A1 * | 2/2018 | Park | H01Q 1/36 |
| 2019/0229413 | A1 * | 7/2019 | Jong | H01Q 1/38 |
| 2020/0201470 | A1 * | 6/2020 | Oh | H01Q 1/52 |
| 2020/0227835 | A1 * | 7/2020 | Kim | H01Q 21/065 |

(Continued)

FOREIGN PATENT DOCUMENTS

| | | | |
|---|---|---|---|
| CN | 203521598 | U | 4/2014 |
| CN | 106104915 | A | 11/2016 |
| CN | 106299602 | A | 1/2017 |

(Continued)

*Primary Examiner* — Hasan Islam
(74) *Attorney, Agent, or Firm* — The PL Law Group, PLLC

(57) ABSTRACT

An antenna structure according to an embodiment of the present invention includes a dielectric layer including a first surface and a second surface which face each other, a first antenna pattern on the first surface of the dielectric layer, the first antenna pattern including a first radiation electrode, and a second antenna pattern on the second surface of the dielectric layer, the second antenna pattern including a second radiation electrode. Radiation gain and efficiency may be improved utilizing both surfaces of the dielectric layer without mutual radiation interruption.

11 Claims, 5 Drawing Sheets

(56) References Cited

U.S. PATENT DOCUMENTS

| | | | | |
|---|---|---|---|---|
| 2020/0251814 | A1* | 8/2020 | Ryu | H01Q 9/0407 |
| 2021/0044011 | A1* | 2/2021 | Liu | H01Q 9/0407 |

FOREIGN PATENT DOCUMENTS

| | | | |
|---|---|---|---|
| CN | 109428165 | A | 3/2019 |
| CN | 212033241 | U | 11/2020 |
| JP | 2001-168637 | A | 6/2001 |
| JP | 2007-306304 | A | 11/2007 |
| JP | 2012-156943 | A | 8/2012 |
| KR | 10-2007-0099195 | A | 10/2007 |
| KR | 10-2010-0034326 | A | 4/2010 |
| KR | 10-2015-0104509 | A | 9/2015 |
| KR | 10-2018-0126877 | A | 11/2018 |
| KR | 10-1940798 | B1 | 1/2019 |
| TW | 200820499 | A | 5/2008 |

* cited by examiner

ANTENNA STRUCTURE

CROSS REFERENCE TO RELATED APPLICATIONS AND CLAIM OF PRIORITY

This application claims benefit under 35 U.S.C. 119(e), 120, 121, or 365(c), and is a National Stage entry from International Application No. PCT/KR2020/003999, filed Mar. 24, 2020 which claims priority to the benefit of Korean Patent Application No. 10-2019-0036794 filed in the Korean Intellectual Property Office on Mar. 29, 2019, the entire contents of which are incorporated herein by reference.

FIELD

The present invention relates to an antenna structure. More particularly, the present invention related to an antenna structure including an antenna pattern and a dielectric layer.

DESCRIPTION OF THE RELATED ART

As mobile communication technologies have been developed recently, an antenna for implementing high frequency or ultra-high frequency communication is employed in various objects such as a display device, a vehicle, an architecture, etc.

For example, a chip-type antenna or an LDS antenna may not be easily fabricated as an antenna for 5G-high frequency communication. Accordingly, film, patch or microstrip type antennas are developed. In this case, a reception bandwidth may become narrower, and a radiation may be limited to one direction due to a ground layer under an antenna pattern.

Additionally, as a frequency band becomes increased, a radiation directivity may be enhanced, but a signal transmission/reception may be easily interrupted or blocked by an external obstacle due to a reduction of refraction or diffraction.

Thus, developments of an antenna that may provide sufficient signal sensitivity and efficiency, and may be operable in a high frequency or ultra-high frequency band may be required.

For example, Korean Patent Application Publication No. 2018-0126877 discloses a glass antenna structure applied to a vehicle such as a train, which may not sufficiently prevent a reduction of a radiation efficiency in a high frequency communication.

SUMMARY

According to an aspect of the present invention, there is provided an antenna structure having improved signal efficiency and reliability.

The above aspects of the present invention will be achieved by the following one or more of features or constructions:

(1) An antenna structure, including: a dielectric layer including a first surface and a second surface which face each other; a first antenna pattern on the first surface of the dielectric layer, the first antenna pattern including a first radiation electrode; and a second antenna pattern on the second surface of the dielectric layer, the second antenna pattern including a second radiation electrode.

(2) The antenna structure according to the above (1), wherein the first antenna pattern and the second antenna pattern do not overlap each other in a planar view.

(3) The antenna structure according to the above (2), wherein the first antenna pattern includes a plurality of first antenna patterns and the second antenna patterns includes a plurality of second antenna patterns, and the first antenna patterns and the second antenna patterns are alternately arranged in the planar view.

(4) The antenna structure according to the above (2), wherein the first antenna pattern and the second antenna pattern are oriented in opposite directions in the planar view.

(5) The antenna structure according to the above (2), further comprising an antenna driving integrated circuit (IC) chip configured to simultaneously drive the first antenna pattern and the second antenna pattern.

(6) The antenna structure according to the above (1), wherein the first antenna pattern and the second antenna pattern overlap each other in a planar view.

(7) The antenna structure according to the above (6), further comprising an antenna driving integrated circuit (IC) chip configured to implement a switching driving of the first antenna pattern and the second antenna pattern.

(8) The antenna structure according to the above (6), wherein the first antenna pattern further includes a first transmission line connected to the first radiation electrode, and the second antenna pattern further includes a second transmission line connected to the second radiation electrode.

(9) The antenna structure according to the above (8), wherein the first radiation electrode overlaps the second transmission line in a thickness direction, and the second radiation electrode overlaps the first transmission line in the thickness direction.

(10) The antenna structure according to the above (1), further including: a first dummy electrode formed on the first surface of the dielectric layer to be separated from the first antenna pattern; and a second dummy electrode formed on the second surface of the dielectric layer to be separated from the second antenna pattern.

(11) The antenna structure according to the above (10), wherein the first radiation electrode and the second radiation electrode include a mesh structure.

(12) The antenna structure according to the above (11), wherein the first dummy electrode and the second dummy electrode include a mesh structure.

(13) The antenna structure according to the above (10), wherein the first dummy electrode overlaps the second radiation electrode in a thickness direction and the second dummy electrode overlaps the first radiation electrode in the thickness direction.

(14) The antenna structure according to the above (10), wherein the first dummy electrode serves as a ground electrode of the second antenna pattern, and the second dummy electrode serves as a ground electrode of the first antenna pattern.

In an antenna structure according to exemplary embodiments of the present invention, antenna patterns may be disposed on upper and lower surfaces of a dielectric layer to implement a radiation through both surfaces of the dielectric layer. Thus, a gain amount through the antenna structure may be increased to overcome low efficiency and low power during a high frequency communication.

Further, high frequency and high-directional antenna patterns may be arranged on both upper and lower surfaces of the dielectric layer so that radiation coverage in both directions of the dielectric layer may be achieved.

In some embodiments, the antenna patterns may be disposed to overlap each other in a planar view. In this case, driving of an upper antenna pattern and a lower antenna pattern may be alternately switched to prevent a mutual radiation interference while achieving a mutual ground operation.

In some embodiments, the antenna patterns may be arranged to be offset from each other in a planar view. In this case, a mutual interference between the upper antenna pattern and the lower antenna pattern may be prevented while providing a simultaneous radiation.

In some embodiments, the antenna structure may include an upper dummy pattern and a lower dummy pattern. The upper and lower dummy patterns may each be provided as a ground for an opposite antenna pattern, and thus an additional ground electrode may be omitted.

DETAILED DESCRIPTION OF THE EMBODIMENTS

According to exemplary embodiments of the present invention, there is provided an antenna structure including a dielectric layer and antenna patterns disposed on upper and lower surfaces of the dielectric layer.

In an embodiment, the antenna structure may be, e.g., a microstrip patch antenna fabricated as a transparent file shape.

In an embodiment, the antenna structure may be embedded in or mounted on, e.g., a glass or a mirror of an automobile to be integrated therewith.

In an embodiment, the antenna structure may be applied to a device for high frequency band or ultrahigh frequency band (e.g., 3G, 4G, 5G or more) mobile communications.

Hereinafter, the present invention will be described in detail with reference to the accompanying drawings. However, those skilled in the art will appreciate that such embodiments described with reference to the accompanying drawings are provided to further understand the spirit of the present invention and do not limit subject matters to be protected as disclosed in the detailed description and appended claims.

Figure 1:
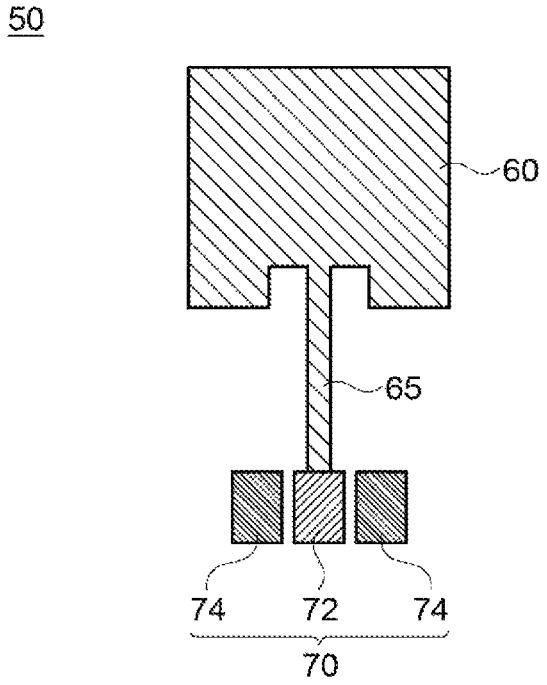
FIG. 1 is a schematic top planar view illustrating a construction of an antenna pattern included in an antenna structure in accordance with exemplary embodiments.

FIG. 1 is a schematic top planar view illustrating a construction of an antenna pattern included in an antenna structure in accordance with exemplary embodiments.

Referring to FIG. 1, an antenna pattern 50 may include a radiation electrode 60, a transmission line 65 and a pad 70.

The radiation electrode 60 may have, e.g., a polygonal plate shape, and the transmission line 65 may extend from a central portion of the radiation electrode 60 to be electrically connected to a signal pad 72. The transmission line 65 may be formed as a single member substantially integral with the radiation electrode 60.

In some embodiments, the pad 70 may include the signal pad 72, and may further include a ground pad 74. For example, a pair of the ground pads 74 may be disposed with respect to the signal pad 72. The ground pads 74 may be electrically separated from the signal pad 72 and the transmission line 65.

In an embodiment, the ground pad 74 may be omitted. The signal pad 72 may also be provided as an integral member formed at an end of the transmission line 65.

The antenna pattern 50 may include silver (Ag), gold (Au), copper (Cu), aluminum (Al), platinum (Pt), palladium (Pd), chromium (Cr), titanium (Ti), tungsten (W), niobium (Nb), tantalum (Ta), vanadium (V), iron (Fe), manganese (Mn), cobalt (Co), nickel (Ni), tin (Sn), zinc (Zn), molybdenum (Mo), calcium (Ca) or an alloy thereof. These may be used alone or in combination thereof.

In an embodiment, the antenna pattern 50 may include silver or a silver alloy to have a low resistance. For example, antenna pattern 50 may include a silver-palladium-copper (APC) alloy.

In an embodiment, the antenna pattern 50 may include copper (Cu) or a copper alloy in consideration of low resistance and pattern formation with a fine line width. For example, antenna pattern 50 may include a copper-calcium (Cu—Ca) alloy.

In an embodiment, the antenna pattern 50 may have a mesh structure containing the above-described metal or alloy to have improved transmittance. For example, the radiation electrode 60 may have a structure in which electrode lines including the metal or alloy intersect each other in a mesh shape.

The transmission line 65 may also include the mesh structure. In an embodiment, the pad 70 may have a solid structure for improving signal transmission rate and reducing resistance.

In an embodiment, the antenna pattern 50 may have a solid structure having a thin transparent metal layer shape. In this case, the resistance may be further reduced, so that feeding and power efficiency may be further improved.

Figure 2:
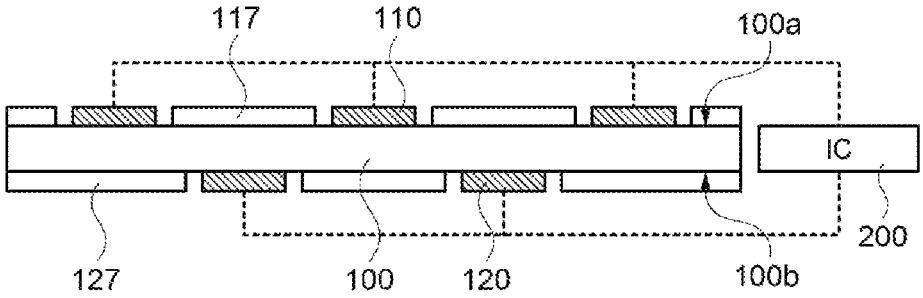
FIGS. 2 and 3 are schematic cross-sectional and top planar views, respectively, illustrating an antenna structure in accordance with exemplary embodiments.
Figure 3:
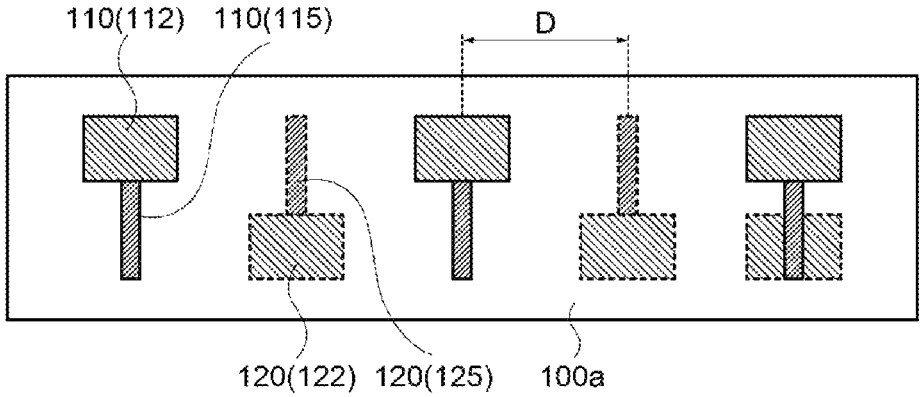

FIGS. 2 and 3 are schematic cross-sectional and top planar views, respectively, illustrating an antenna structure in accordance with exemplary embodiments. Specifically, FIG. 3 is a plan view from above a first surface 100*a* of the dielectric layer 100. For convenience of descriptions, a second antenna pattern 120 is illustrated by a dotted line in FIG. 2, and illustrations of dummy electrodes 117 and 127 are omitted.

Referring to FIGS. 2 and 3, the antenna structure may include a dielectric layer 100 and antenna patterns 110 and 120.

The dielectric layer 100 may include glass. For example, a transparent glass such as an automobile glass or mirror may be provided directly as the dielectric layer 100 of the antenna structure.

In an embodiment, the dielectric layer 100 may include a transparent resin material. For example, the dielectric layer 100 may include a polyester-based resin such as polyethylene terephthalate, polyethylene isophthalate, polyethylene naphthalate, polybutylene terephthalate, etc.; a cellulose-based resin such as diacetyl cellulose, triacetyl cellulose, etc.; a polycarbonate-based resin; an acrylic resin such as polymethyl (meth)acrylate, polyethyl (meth)acrylate, etc.; a styrene-based resin such as polystyrene, an acrylonitrile-styrene copolymer, etc.; a polyolefin-based resin such as polyethylene, polypropylene, a cyclo-based or norbornene-structured polyolefin, an ethylene-propylene copolymer, etc.; a vinyl chloride-based resin; an amide-based resin such as nylon, an aromatic polyamide, etc.; an imide-based resin; a polyether sulfone-based resin; a sulfone-based resin; a polyether ether ketone-based resin; a polyphenylene sulfide-based resin; a vinyl alcohol-based resin; a vinylidene chloride-based resin; a vinyl butyral-based resin; an allylate-based resin; a polyoxymethylene-based resin; an epoxy-based resin; a urethane or acryl urethane-based resin; a silicone-based resin, etc. These may be used alone or a combination thereof.

In some embodiments, an adhesive film including, e.g., as an optically clear adhesive (OCA), an optically clear resin (OCR), or the like may be included in the dielectric layer 100.

In some embodiments, the dielectric layer 100 may include an inorganic insulating material such as glass, silicon oxide, silicon nitride, silicon oxynitride, or the like.

A capacitance or an inductance may be generated by the dielectric layer 100 so that a frequency band for an operation or sensing of the antenna structure may be adjusted. In some embodiments, a dielectric constant of dielectric layer 100 may be adjusted in a range from about 1.5 to about 12, preferably from about 2 to about 12. If the dielectric constant exceeds about 12, a driving frequency may be excessively reduced and an antenna driving in a desired high frequency band may not be obtained.

The dielectric layer 100 may include a first surface 100*a* and a second surface 100*b* facing each other. The first surface 100*a* and the second surface 100*b* may correspond to an upper surface and a lower surface of the dielectric layer 100, respectively. If the dielectric layer 100 includes a glass product, the first surface 100*a* may correspond to an externally exposed surface and the second surface 100*b* may correspond to an inner surface facing an inside of a device or a structure.

The antenna patterns of the antenna structure may include a first antenna pattern 110 and a second antenna pattern 120. The first antenna pattern 110 may be disposed on the first surface 100*a* of the dielectric layer 100, and the second antenna pattern 120 may be disposed on the second surface 100*b* of the dielectric layer 100.

For example, a plurality of the first antenna patterns 110 may be arranged on the first surface 100*a* of the dielectric layer 100 to form an array. Additionally, a plurality of the second antenna patterns 120 may be arranged on the second surface 100*b* of the dielectric layer 100 to form an array.

The antenna patterns 110 and 120 may have a structure as described with reference to FIG. 1. For convenience of descriptions, an illustration of the pad 70 of FIG. 1 is omitted in FIG. 3.

As illustrated in FIG. 3, the first antenna patterns 110 and the second antenna patterns 120 may be arranged to be offset from each other in a planar view. In exemplary embodiments, the first antenna patterns 110 and the second antenna patterns 120 may be alternately arranged along a horizontal direction in FIG. 3. Accordingly, the first antenna patterns 110 and the second antenna patterns 120 may not overlap each other in the planar view.

As illustrated in FIG. 2, the first antenna patterns 110 and the second antenna patterns 120 may be electrically connected to an antenna driving integrated circuit (IC) chip 200, respectively. For example, the antenna driving IC chip 200 and the antenna patterns 110 and 120 may be electrically connected to each other via a flexible printed circuit board (FPCB) bonded or connected to the signal pads 72 (see FIG. 1) included in the antenna patterns 110 and 120.

A feeding to the antenna patterns 110 and 120 and a driving frequency control may be performed by the antenna driving IC chip 200. In some embodiments, the antenna driving IC chip 200 may be mounted directly on the FPCB.

In some embodiments, a simultaneous radiation may be performed from the first antenna pattern 110 and the second antenna pattern 120 by the antenna driving IC chip 200. Accordingly, a double-sided radiation through the upper and lower surfaces of the dielectric layer 100 may be implemented to increase a gain amount. Further, power efficiency degradation and narrow band which may be caused in a film type high frequency antenna may be resolved through the double-sided radiation.

As described above, the first antenna patterns 110 and the second antenna patterns 120 may be arranged to be offset from each other. Thus, even though the simultaneous radiation is performed from both surfaces of the dielectric layer 100, radiation interference and disturbance between the first antenna pattern 110 and the second antenna pattern 120 adjacent to each other may be prevented. Additionally, signal disturbance due to a parasitic capacitance generation between the first antenna pattern 110 and the second antenna pattern 120 may be suppressed.

As illustrated in FIG. 2, a first dummy electrode 117 may be disposed between the first antenna patterns 110, and a second dummy electrode 127 may be disposed between the second antenna patterns 120.

The first dummy electrode 117 may be formed on the first surface 100*a* of the dielectric layer 100, and may be electrically and physically separated from the first antenna pattern 110. The second dummy electrode 127 may be formed on the second surface 100*b* of the dielectric layer 100, and may be electrically and physically separated from the second antenna pattern 120.

For example, a thin film electrode layer including the above-described metal or alloy may be formed on each of the first surface 100*a* and the second surface 100*b* of the dielectric layer 100. The thin film electrode layer may be partially etched along a profile of the antenna patterns 110 and 120 to form the antenna patterns 110 and 120. Remaining portions of the thin film electrode layer except for portions converted into the antenna patterns 110 and 120 may be used as the dummy electrodes 117 and 127.

The first antenna pattern 110 may overlap the second dummy electrode 127 in a thickness direction. The second dummy electrode 127 may serve as a ground electrode of the first antenna pattern 110. The second antenna pattern 120 may overlap the first dummy electrode 117 in the thickness direction. The first dummy electrode 117 may serve as a ground electrode of the second antenna pattern 120.

Thus, a bi-directional vertical radiation through both sides of the dielectric layer 100 may be implemented without forming a separate ground electrode or a ground line for each antenna pattern 110 and 120.

In some embodiments, as illustrated in FIG. 3, the first antenna pattern 110 and the second antenna pattern 120 may be disposed in a reverse orientation in a planar view. For example, a first radiation electrode 112 of the first antenna pattern 110 may be disposed upwardly in FIG. 3, and a second radiation electrode 122 of the second antenna pattern 120 may be disposed downwardly in FIG. 3.

Thus, a second transmission line 125 of the second antenna pattern 120 may be disposed between the neighboring first radiation electrodes 112 in the planar view, and a first transmission line 115 of the first antenna pattern 110 may be disposed between the neighboring second radiation electrodes 122 in the planar view.

Pattern orientations of the first antenna pattern 110 and the second antenna pattern 120 may be opposite to each other as described above, so that radiation interference between the first and second antenna patterns 110 and 120 may be blocked more effectively to enhance reliability of the bi-directional vertical radiation.

In some embodiments, a spacing distance D between the first antenna pattern 110 and the second antenna pattern 120 neighboring in the planar view (e.g., a distance between central lines of the first and second antenna patterns 110 and 120) may be greater than or equal to a half wavelength of a resonance frequency to suppress mutual radiation interference.

Figure 4:
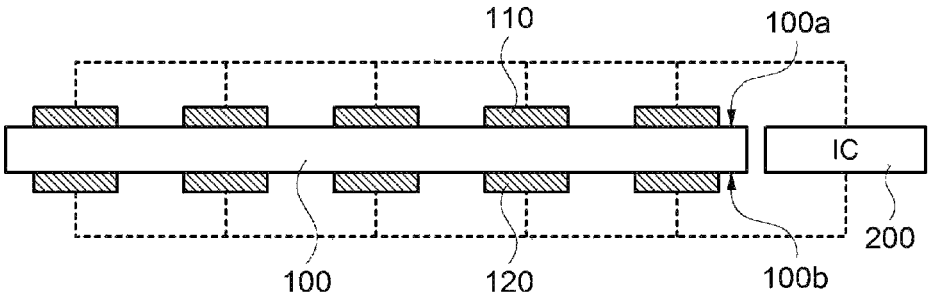
FIGS. 4 and 5 are schematic cross-sectional and top planar views, respectively, illustrating an antenna structure in accordance with exemplary embodiments.
Figure 5:
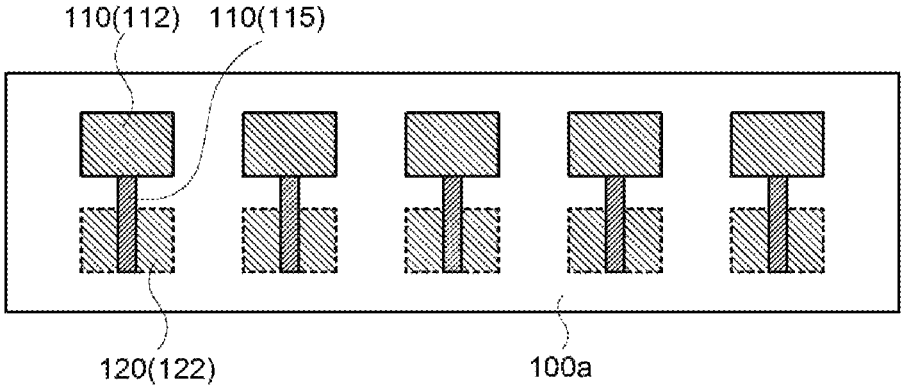

FIGS. 4 and 5 are schematic cross-sectional and top planar views, respectively, illustrating an antenna structure in accordance with exemplary embodiments. Detailed descriptions on elements and structures substantially the same as or similar to those described with reference to FIGS. 2 and 3 are omitted herein.

Referring to FIGS. 4 and 5, the first antenna pattern 110 and the second antenna pattern 120 may be disposed on the first surface 100*a* and the second surface 100*b* of the dielectric layer 100, respectively.

In exemplary embodiments, the first antenna pattern 110 and the second antenna pattern 120 may be disposed to overlap each other in a planar view. In this case, an antenna gain may be enhanced by increasing an antenna pattern density at each of the first and second surfaces 100*a* and 100*b* of the dielectric layer 100.

For example, a spacing distance between the neighboring first antenna patterns 110 and a spacing distance between the neighboring second antenna patterns 120 may each be greater than or equal to a half wavelength of a resonance frequency.

The antenna driving IC chip 200 may be electrically connected to each of the first antenna patterns 110 and the second antenna patterns 120 to perform feeding and signal transmission. In exemplary embodiments, a switching driving of the first antenna pattern 110 and the second antenna pattern 120 may be implemented by the antenna driving IC chip 200.

For example, when a feeding of the first antenna pattern 110 is performed by the antenna driver IC chip 200, a feeding of the second antenna pattern 120 may be ceased. Additionally, when a feeding of the second antenna pattern 120 is performed, a feeding of the first antenna pattern 110 may be ceased.

In an embodiment, the first antenna pattern 110 and the second antenna pattern 120 may be alternately driven by the antenna driving IC chip 200. In this case, a vertical radiation in a direction of the first surface 100*a* of the dielectric layer 100 and a vertical radiation in a direction of the second surface 100*b* may be alternately performed.

As described above, the antenna patterns 110 and 120 may be disposed to overlap each other, and the antenna driving therefrom may be switched to prevent mutual radiation interference between the first and second antenna patterns 110 and 120.

In some embodiments, as described with reference to FIGS. 2 and 3, the first antenna pattern 110 and the second antenna pattern 120 may be arranged in a reverse orientation. For example, the first radiation electrode 112 of the first antenna pattern 110 may overlap the second transmission line (not illustrated) of the second antenna pattern 120 in a thickness direction. The second radiation electrode 122 of the second antenna pattern 120 may overlap the first transmission line 115 of the first antenna pattern 110 in the thickness direction.

Accordingly, the first antenna pattern 110 and the second antenna pattern 120 may face each other without overlap of the radiation electrodes in the planar view. In this case, the radiation electrodes may be oriented to be opposite to each other, so that the first antenna pattern 110 and the second antenna pattern 120 may be simultaneously driven by the antenna driver IC chip 200 (a simultaneous radiation or a simultaneous feeding) while reducing or suppressing mutual interference between the radiation electrodes.

In an embodiment, the radiation electrodes 112 and 122 of the first antenna pattern 110 and the second antenna pattern 120 may overlap each other in the thickness direction. In this case, driving of the first antenna pattern 110 and the second antenna pattern 120 may be switched by the antenna driver IC chip 200 as described above, and thus mutual radiation interference may be avoided even when the radiation electrodes 112 and 122 overlap each other.

In some embodiments, as described with reference to FIG. 2, a first dummy electrode may be formed on the first surface 100*a* of the dielectric layer 100, and the second dummy electrode may be formed on the second surface 100*b* of the dielectric layer 100.

The first dummy electrode may overlap the second radiation electrode 122 of the second antenna pattern 120 in the thickness direction and may serve as a ground electrode of the second antenna pattern 120. The second dummy electrode may overlap the first radiation electrode 112 of the first antenna pattern 110 in the thickness direction and may serve as a ground electrode of the first antenna pattern 110.

Figure 6:
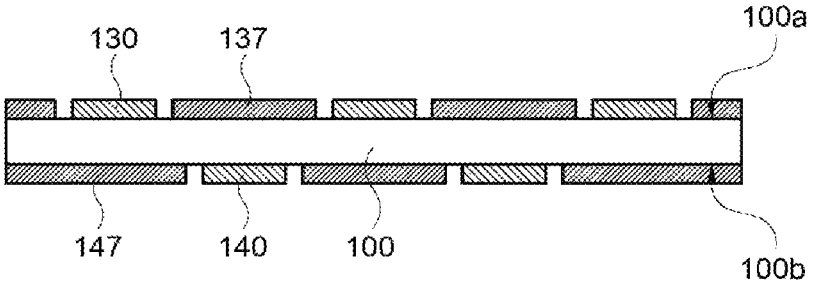
FIGS. 6 and 7 are schematic cross-sectional and top planar views, respectively, illustrating an antenna structure in accordance with exemplary embodiments.
Figure 7:
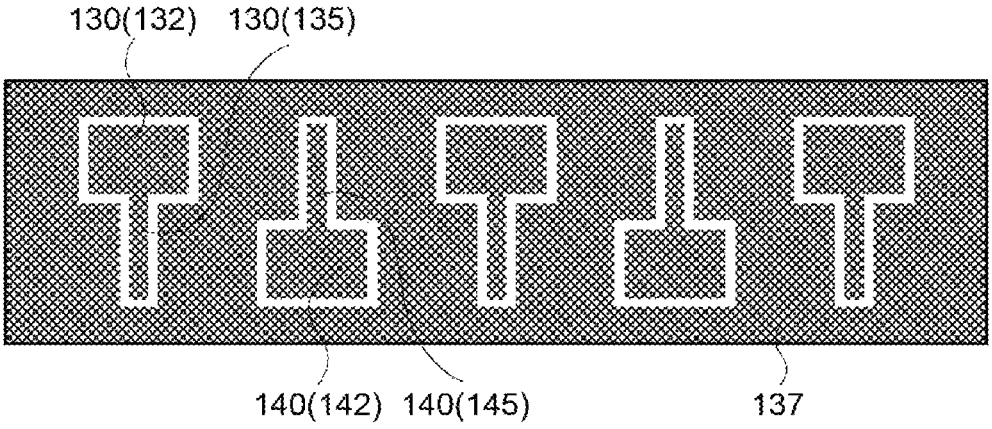

FIGS. 6 and 7 are schematic cross-sectional and top planar views, respectively, illustrating an antenna structure in accordance with exemplary embodiments. Detailed descriptions on elements and structures substantially the same as or similar to those described with reference to FIGS. 2 and 3 are omitted herein.

Referring to FIGS. 6 and 7, a first antenna pattern 130 may be disposed on the first surface 100*a* of the dielectric layer 100, and a second antenna pattern 140 may be disposed on the second surface 100*b* of the dielectric layer 100. The first antenna pattern 130 may include a first radiation electrode 132 and a first transmission line 135, and the second antenna pattern 140 may include a second radiation electrode 142 and a second transmission line 145.

The first and second antenna patterns 130 and 140 may each have a mesh structure. A first dummy electrode 137 having a mesh structure may be formed around the first antenna pattern 130 on the first surface 100*a* of the dielectric layer 100, and a second dummy electrode 147 having a mesh structure may be formed around the second antenna pattern 140 on the second surface 100*b* of the dielectric layer 100.

In some embodiments, the antenna patterns 130 and 140 and the dummy electrodes 137 and 147 may include a mesh structure having substantially the same shape and structure.

In some embodiments, the mesh structure included in the dummy electrodes 137 and 147 may have a shape different from that of the antenna patterns 130 and 140. For example, the mesh structure included in the dummy electrodes 137 and 147 may include a cut portion or may have a changed shape at a portion adjacent to the antenna patterns 130 and 140.

The dummy electrodes 137 and 147 may be electrically and physically separated from the antenna patterns 130 and 140. For example, a mesh-shaped conductive layer may be formed on the first surface 100*a* and the second surface 100*b* of the dielectric layer 100, and the conductive layer may be partially etched along profiles of the antenna patterns 130 and 140 to form the dummy electrodes 137 and 147 separated from the antenna patterns 130 and 140.

The antenna patterns 130 and 140 or the radiation electrodes 132 and 142 may include the mesh structure so that an entire transmittance of the antenna structure may be improved. Further, the dummy electrodes 137 and 147 having the mesh structure may be disposed to increase a pattern uniformity. Thus, the antenna patterns 130 and 140 may be prevented from being recognized by a user due to a pattern deviation.

The first dummy electrode 137 may overlap the second antenna pattern 140 in a thickness direction and may serve as a ground electrode of the second radiation electrode 142. The second dummy electrode 147 may overlap the first antenna pattern 130 in the thickness direction and may serve as a ground electrode of the first radiation electrode 132.

As described above with reference to FIGS. 2 and 3, the first antenna pattern 130 and the second antenna pattern 140 may be offset from each other in a planar view and may not overlap in the planar view. Additionally, the first antenna pattern 130 and the second antenna pattern 140 may be arranged in opposite orientations in the planar view.

Figure 8:
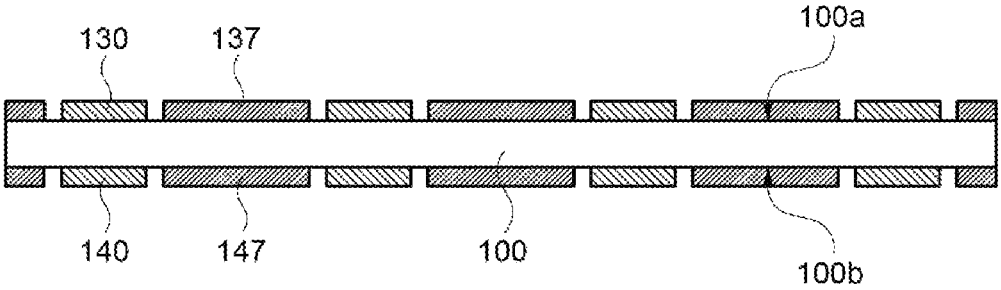
FIGS. 8 and 9 are schematic cross-sectional and top planar views, respectively, illustrating an antenna structure in accordance with exemplary embodiments.
Figure 9:
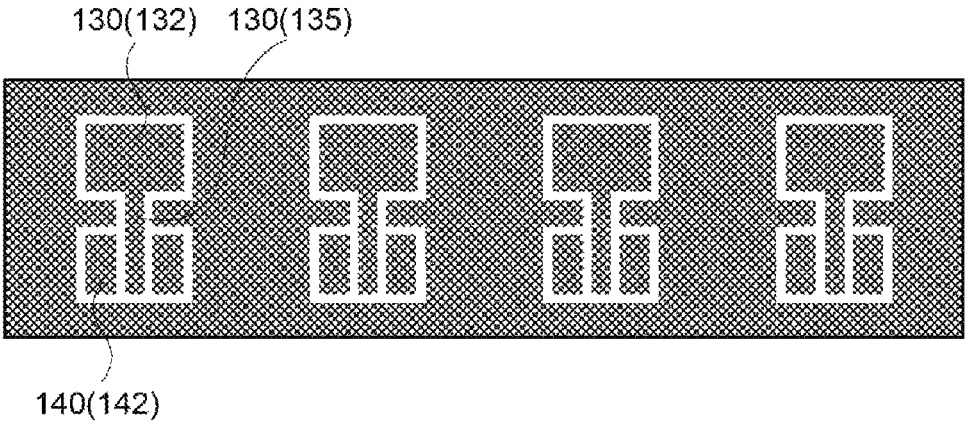

FIGS. 8 and 9 are schematic cross-sectional and top planar views, respectively, illustrating an antenna structure in accordance with exemplary embodiments.

Referring to FIGS. 8 and 9, as described above, the antenna patterns 130 and 140 or the radiation electrodes 132 and 142 may include a mesh structure. The dummy electrodes 137 and 147 including mesh structures having substantially the same shape and structure as those of the antenna patterns 130 and 140 may be formed around the antenna patterns 130 and 140.

As described with reference to FIGS. 4 and 5, the first antenna pattern 130 and the second antenna pattern 140 may be aligned to overlap each other in the thickness direction. In this case, driving of the first antenna pattern 130 and the second antenna pattern 140 may be switched by the antenna driver IC chip 200 to prevent mutual radiation interference.

In the switching driving, the first dummy electrode 137 may serve as a ground electrode of the second radiation electrode 142, and the second dummy electrode 147 may serve as the ground electrode of the first radiation electrode 132.

The antenna structure according to the exemplary embodiments described above may be applied to, e.g., an automobile glass, an automobile mirror, or the like, to effectively implement high efficiency and power communication through a high frequency bi-directional vertical radiation while maintaining high transparency. The antenna structure may be effectively applied to various devices and structures such as a display device or a mobile communication device.

Hereinafter, preferred embodiments are proposed to more concretely describe the present invention. However, the following examples are only given for illustrating the present invention and those skilled in the related art will obviously understand that these examples do not restrict the appended claims but various alterations and modifications are possible within the scope and spirit of the present invention. Such alterations and modifications are duly included in the appended claims.

Example

A conductive layer including a mesh structure (line width: 2 μm) using an alloy of silver (Ag), palladium (Pd) and copper (Cu) was formed on upper and lower surfaces of a dielectric layer formed of glass. The conductive layer was etched to form eight radiation electrodes (each having width: 100 μm, length: 200 μm, thickness: 2 μm) on each of the upper and lower surfaces such that the radiation electrodes overlapped each other in a planar view. The remaining conductive layer portion except for the radiation electrodes was formed as a dummy electrode.

Comparative Example

Radiation electrodes having the same size as that in Example were formed on the upper surface of the dielectric layer. A conductive layer the same as that in Example was formed entirely on the lower surface of the dielectric layer (not etched) to serve as a ground electrode of the radiation electrodes.

Experimental Example

S-parameters (S11) of outermost radiation electrodes (an upper outermost radiation electrode and a lower outermost radiation electrode) among the radiation electrodes on the upper and lower surfaces of the dielectric layer in Example were extracted using Vector Network Analyzer (MS4644B manufactured by Anritsu) at a frequency of about 28.5 GHz.

Additionally, S-parameters (S11) of central radiation electrodes (a radiation at a 4th position) among the radiation electrodes on the upper and lower surfaces of the dielectric layer in Example were extracted using the same method as mentioned above.

An S11 value of the radiation electrodes in Comparative Example were obtained by the same method.

Further, resonance frequencies were measured while changing frequencies of the radiation electrodes in Example and Comparative Example.

The results are shown in Table 1 below.

TABLE 1

| | | Example | | | |
|---|---|---|---|---|---|
| | Comparative Example | outermost/ upper surface | outermost/ lower surface | central/ upper surface | central/ lower surface |
| S11 | −18.10 | −22.49 | −20.14 | −24.61 | −26.34 |
| Resonance Frequency | 25-26 GHZ | | 28-30 GHz | | |

Referring to Table 1, the antenna of Example utilizing the upper and lower surfaces of the dielectric layer provided improved efficiency and reduced signal loss compared to those in Comparative Example. Further, the resonance frequency in Example shifted to higher frequency band.

What is claimed is:

1. An antenna structure, comprising:

a dielectric layer including a first surface and a second surface which face each other;

a first antenna pattern on the first surface of the dielectric layer, the first antenna pattern comprising a first radiation electrode;

a second antenna pattern on the second surface of the dielectric layer, the second antenna pattern comprising a second radiation electrode, a first dummy electrode formed on the first surface of the dielectric layer to be separated from the first antenna pattern; and a second dummy electrode formed on the second surface of the dielectric layer to be separated from the second antenna pattern, wherein the first antenna pattern and the second antenna pattern are oriented in opposite direction in a planar view, and the first radiation electrode and the second radiation electrode do not overlap each other in the planar view; and the first radiation electrode and the second radiation electrode include a mesh structure.

2. The antenna structure according to claim 1, wherein the first antenna pattern and the second antenna pattern do not overlap each other in a planar view.

3. The antenna structure according to claim 2, wherein a plurality of the first antenna patterns and a plurality of the second antenna patterns are alternately arranged in the planar view.

4. The antenna structure according to claim 2, further comprising an antenna driving integrated circuit (IC) chip configured to simultaneously drive the first antenna pattern and the second antenna pattern.

5. The antenna structure according to claim 1, wherein the first antenna pattern and the second antenna pattern overlap each other in a planar view.

6. The antenna structure according to claim 5, further comprising an antenna driving integrated circuit (IC) chip configured to implement a switching driving of the first antenna pattern and the second antenna pattern.

7. The antenna structure according to claim 5, wherein the first antenna pattern further comprises a first transmission line connected to the first radiation electrode, and the second antenna pattern further comprises a second transmission line connected to the second radiation electrode.

8. The antenna structure according to claim 7, wherein the first radiation electrode overlaps the second transmission line in a thickness direction, and the second radiation electrode overlaps the first transmission line in the thickness direction.

9. The antenna structure according to claim 1, wherein the first dummy electrode and the second dummy electrode include a mesh structure.

10. The antenna structure according to claim 1, wherein the first dummy electrode overlaps the second radiation electrode in a thickness direction and the second dummy electrode overlaps the first radiation electrode in the thickness direction.

11. The antenna structure according to claim 1, wherein the first dummy electrode serves as a ground electrode of the second antenna pattern, and the second dummy electrode serves as a ground electrode of the first antenna pattern.

* * * * *